US005624471A

United States Patent [19]

Gaeta et al.

[11] Patent Number: 5,624,471

[45] Date of Patent: Apr. 29, 1997

[54] WATERPROOF PAPER-BACKED COATED ABRASIVES

[75] Inventors: Anthony C. Gaeta, Lockport; Gwo S. Swei, East Amherst, both of N.Y.

[73] Assignee: Norton Company, Worcester, Mass.

[21] Appl. No.: 681,236

[22] Filed: Jul. 22, 1996

[51] Int. Cl.[6] ..... B24D 11/00

[52] U.S. Cl. ..... 51/295; 51/298

[58] Field of Search ..... 51/293, 295, 298

[56] References Cited

U.S. PATENT DOCUMENTS 5,551,962 9/1996 Ho ..... 51/295

*Primary Examiner*—Deborah Jones

*Attorney, Agent, or Firm*—David Bennett

[57] ABSTRACT

Waterproof coated abrasive paper made using a maker and/or size coat comprising a radiation-curable binder that is hydrophobic when polymerized.

11 Claims, No Drawings

WATERPROOF PAPER-BACKED COATED ABRASIVES

BACKGROUND TO THE INVENTION

The present invention relates to the production of coated abrasives and particularly to the production of coated abrasives with a paper backing and more specifically to waterproof coated abrasives.

Such materials typically comprise a paper backing with the grain held by phenolic-modifed varnish resin maker and size coats. The use of the modified varnish as the bond renders the product waterproof. However it is found that such products require several hours to complete the cure of the binders and this therefore implies a very large inventory of "goods-in-progress" An alternative water-proofing treatment involves the use of a latex rubber saturant for the paper substrate.

It has therefore been proposed to use radiation-curable resin binders in place of the conventional phenolic resin-modified varnishes. Unfortunately the use of UV-radiation as the cure mechanism can not be applied from the backing side. In addition the UV radiation has very limited penetration and if the paper is highly filled, (as is often the case), the grains cast a UV shadow and the cure can be non-uniform. Faster cures may be obtained using electron beam radiation which is much more penetrating. Unfortunately such exposure tends to degrade the paper, leading to a product with reduced internal strength and integrity.

A waterproof paper-backed abrasive product has now been developed which has outstanding water resistance, flexibility and abrasive performance and yet can be produced with a cure time measured in seconds rather than hours or even minutes.

General Description of the Invention

In a preferred aspect of the invention the paper-backed coated abrasive is provided with a hydrophobic radiation-curable resin maker and/or size coat. The resin is preferably selected to display hydrophobic qualities by which is meant that the cured surface is water-repellant and will not be degraded by water.

This hydrophobicity can also be caused, or alternatively enhanced, According to a further preferred feature of this invention by the addition of a hydrophobic additive to a binder coat.

The preferred cure mechanism is UV radiation optionally followed, after UV initiation of the cure, by a thermal treatment. This can often be desirable where full UV cure is inhibited by the abrasive components or a greater depth of cure is desired.

In the event the radiation cure mechanism employed is electron beam radiation, it is often advisable to provide that the paper used as the backing is reinforced with synthetic fibers that are resistant to degradation when exposed to electron beam radiation. Such papers are frequently referred to as FRP and the use of such papers is a preferred aspect of at least one embodiment of this invention.

Thus the waterproof paper-backed coated abrasive of one embodiment of the invention comprises a cellulosic paper backing reinforced with at least 5% by weight of synthetic polymer fibers resistant to electron beam radiation.

The synthetic polymer fibers are resistant to electron beam radiation and by that is meant that the paper into which they are incorporated at a level of 10% by weight or more retains at least 25% more of its strength after being submitted to an electron beam radiation treatment than a cellulosic paper similar in all respects except for the absence of the fiber reinforcement. The fibers in commercial examples of FRP are often entangled with the cellulosic fibers rather than being laid on the paper surface. In this way they contribute to or modify the tear strength of the paper. Such papers are well known commercial products and are used in a wide range of applications.

Detailed Desription of the Invention

The binder formulation providing one or both of the maker and size coats is one that incorporates a resin that is curable at least in part by radiation, and most preferably by UV radiation. Such resins, which typically polymerize via a free-radical mechanism include epoxy-acrylates, aminoplast derivatives having pendant α,β-unsaturated carbonyl groups, ethylenically unsaturated compounds, isocyanurate derivatives having at least one pendant acrylate group, isocyanates having at least one pendant acrylate group, urethane-acrylates, epoxy-novolacs and mixtures thereof.

Acrylated urethanes include for example diacrylate esters of hydroxyterminated isocyanate extended polyesters or poyethers. Acrylated epoxies include for example the diacrylate esters of bisphenol derivatives such bisphenol A epoxy resins. Typical aminoplast derivatives have at least 1.1 pendant α,β-unsaturated carbonyl groups. Suitable ethylenically unsaturated compounds include monomeric or polymeric compounds that contain atoms of carbon, hydrogen and oxygen, and optionally nitrogen and the halogens. Oxygen and nitrogen atoms are generally present in ether, ester, urethane, amide or urea groups. Typical isocyanate derivatives have at least one pendant acryalte group.

Examples of such resins are conventionally made by the reaction of an acrylate monomer or oligomer, (including di- and tri-acrylates), with a novolac, epoxy or urethane polymer or oligomer. The properties of the final resin can be manipulated by changing the proportions of the components. Usually in the production of a binder resin, the desired properties are hardness and toughness.

Where the resin binder is not itself hydrophobic, this property must be conferred by the addition of copolymerizable monomer that confers hydrophobicity such as a siloxane with pendant acrylate functionalities. Epoxyacrylates often have sufficient hydrophobicity, particularly those epoxyacrylates that are liquid and require no additional solvents to permit them to be applied in a binder coat. These have the additional advantage that no solvent need be removed during the cure process. One such epoxyacrylate is available from UCB Radcure under the trade name Ebecryl 3605.

If the binder is cured by UV radiation, a photoinitaitor is usually required to initiate free-radical polymerization. Examples of suitable photoinitiators include, benzophenones, phosphine oxides, nitroso compounds, acryl halides, hydrazones, mercapto compounds, pyrillium compounds, triacrylimidazoles, benzimidazoles, chloroalkyl triazines, benzoin ethers, benzil ketals, thioxanthones, camphorquinone, and acetophenone derivatives. Cationic photoinitiators may also be used and exampes of such photoinitiators include aryl diazonium, arylsulfonium, aryliodonium and ferrocenium salts.

Thermal initiators are often desirable additional components since they can be activated the heat liberated during the cure initiated by the UV cure, thus increasing the degree or depth of cure and possibly eliminating the need for post-cure operations. Suitable thermal intiators include azo compounds, imidazoles and organic peroxides such as diacyl peroxides, acetyl sulfonyl peroxides, dialkyl peroxydicarbonates, tert alkyl peroxyesters, O,O-tert-alkyl)-alkyl monoperoxycarbonates, di(tert-alkylperoxy)ketals, di(tert-alkyl)peroxides, tert-alkyl hydroperoxides and ketone peroxides.

The UV radiation is usually supplied at a wavelength between about 200 to 700 nanometers and more preferably between about 250 and 400 nanometers. It may be supplemented by a heat treatment applied simultaneously or subsequently to the UV radiation.

An electron beam radiation treatment, where this is used, typically applies an accelerating voltage of from about 150 kv to 400 kv, though some scanning electron beam devices operate at acceperating voltages in excess of 500 kv. The typical electron beam equipment can penetrate substances with a density of up to about 750 gm/m$^2$.

The binder formulation optionally can derive or enhance its hydrophobicity from the incorporation of additives such as a silane or a siloxane having functional groups that enable the silane or siloxane to bond effectively to the binder resin, such as hydroxyl or acrylate functional groups, while retaining an overall hydrophobic character. Silanes are inherently hydrophobic and therefore increase the water resistance of the coated abrasive product. Such a silane is conveniently incorporated in the size coat and additional amounts can also be incorporated in a separate coat applied over the size coat. This can be done in conjunction with other additives such as anti-static or anti-loading additives, or grinding aids. An example of a suitable silane is γ-methacryloxypropyltrimethoxy silane and an example of a siloxane that can be used in this function is BYK-371, a siloxane containing pendant acrylate groups available from BYK Chemie.

The abrasive grit bonded to the backing to produce the coated abrasive of the invention can be any of those commonly used to produce coated abrasives. These include aluminum oxide, (both fused and sintered), silicon carbide, fused alumina/zirconia, cubic boron nitride, diamond and blends of any two or more of the above.

Where electron-beam radiation is the selected cure mechanism, as was explained above, it is preferred to use paper incorporating reinforcing fibers, (such reinforced papers are commonly called "FRP"s). Suitable reinforcing fibers for use in preparing the FRPs include polyester, polyolefin, polyamide, polyacrylonitrile, polycarbonate and copolymers of the above as well as mixtures of such fibers.

Commercial FRPs, usually contain about 10 to about 40% by weight of the reinforcing polymer fibers. The most preferred reinforcing fibers are made from polyesters such as polyethylene terephthalate or polyamides such as nylon 66. The fibers are usually staple fibers but it is possible to use tangled continuous filaments also though the FRP production process then becomes somewhat complicated. The diameter of the synthetic polymer fibers is usually about the same as that of the cellulosic fibers with which it is entangled, but the diameter can be somewhat larger or smaller without departing from the essential scope of the invention.

The preferred FRPs used in the products of the invention usually comprise from 10 to 40% and preferably from 15 to 30% by weight of the synthetic fibers. Clearly the thicker the fibers, the nearer the top end of this range the synthetic fiber content is likely to be.

DESCRIPTION OF PREFERRED EMBODIMENTS

The invention is now described with reference to the following illustrative examples which are not intended to imply any necessary limitation on the essential scope of the present invention.

Example 1

This Example shows the performance of coated abrasive materials made using an electron beam radiation curing mechanism. The coated abrasive was cut into discs for the tests. These were compared with commercial "Fastcut" waterproof paper discs (made using a conventional phenolic resin varnish binder system, binding SiC abrasive grits to a rubber-latex saturated A-weight paper substrate), using the Schieffer test.

In this test a disc about 11.4 cm in diameter is attached to a backup support pad using a ring-clamping device in a horizontal position. A cylindrical workpiece made of 6061 aluminum with an outside diameter of 2.54 cm and a length of 5.08 cm is then moved into contact with the pad at a predetermined constant force and is rotated for a predetermined number of revolutions. In the present case the force chosen was 7 lbs (31 newtons) and the number of revolutions was set at 400.

After this had been completed, the difference in weights of both the workpiece and the disc were measured and recorded.

The test was carried out on discs prepared using the E-Beam curable maker and size coats described below. The Schieffer test data were compared against those obtained using the commercial waterproof paper-backed disc.

Paper: Tanco A2, C-39406 from Kimberly Clark

Maker Coat: Uvithane 783 aliphatic diacrylated urethane available from Morton International N-vinyl pyrrolidone Isobornyl acrylate FC-171 surfactant BYK-A510 air release agent A174 silane coupling agent Size Coat: Ebecryl 3603 tri-functional acrylated epoxy novolac available from UCB N-vinyl pyrrolidone Isobornyl acrylate FC-171 surfactant BYK-A510 air release agent A174 silane coupling agent Cure Time:

Commercial Control: 6–7 hours at 121° C.

E-Beam Cure: A few seconds.

TABLE 1

| SAMPLE | SAMPLE CUT | DISC LOSS | CUT/LOSS |
|---|---|---|---|
| CONTROL | 0.6 | 0.13 | 4.62 |
| E-BEAM CURE | 0.5 | 0.1 | 5.00 |

The grit in each case was silicon carbide (180 grit). As can be seen, the abrasive performance of the waterproof paper made using an E-Beam curing formulation was essentially equivalent to that of the commercial waterproof paper.

Example 2

This Example shows the resistance to E-Beam exposure of a fiber-reinforced paper by comparison with regular paper.

In the graph attached as FIG. 1, the tear strength of a FRP is compared against that of a similar weight regular paper such as is commonly used in commercial waterproof abrasive paper applications.

The FRP is a Kimberly Clark product sold under the identifier C75148 "A" weight. It comprises synthetic fiber reinforcement. The comparison paper is the commercially used Tanco A2 paper identified in Example 1.

In each case the papers were exposed to electron beam radiation at 350 kilovolts. The tear strength was measured at regular intervals and the percentage retention of the initial tear strength was charted against the total radiation received in Megarads, (Mrads).

Standard papers are seriously degraded by the E-Beam treatment which is why such cure techniques have not previously been used in spite of the great savings in time involved. Typical doses required to cure most acrylate coatings ranges from 2 to 5 Mrads per pass, (8 to 12 Mrads for methacrylates). Thus paper substrates will often be degraded after curing both the maker and size coats. The use of FRP essentially removes this problem and permits the use of this advantageous technology.

Example 3

This Example compares four samples of waterproof abrasive papers: one standard control made using a latex rubber saturant for the abrasive paper prepare by conventional techniques, (the "FastCut" commercial product used in Example 1). The test method was the Schieffer test described in Example 1.

The formulations according to the invention compared with the "FastCut" disc were as follows:

1. E-Beam Cured Sample This sample used as the binder in the maker and size coats, a 80/20 mixture of Ebecryl 3605, (an acrylated epoxy oligomer available under this trade name from UCB Radcure Inc.) and N-vinyl pyrrolidone, (NVP).
2. UV Cured Sample This sample contained, in addition to the Ebecryl 3605 and NVP of Sample 1, 3% of a photoinitiator Darocure 1173, available under that trade name from Ciba-Geigy.
3. UV/Cationic Cured Sample In addition to the components in Sample 2, this contained 4% of Cyracure UVI-6974, which is an antimony onium salt, available under that trade name from Union Carbide, and which functions to promote cationic cure mechanisms.

The grit in each case was silicon carbide 60 grit. In the first set of comparisons the binder formualtions according to the invention were given in which the E-Beam cured sample was cured at 2 Mrads with a line speed of 30 feet/minute. The UV-cured sample was exposed, sequentially to one 300 watt/inch Fusion "D" bulb and one 400 watt/inch "H" bulb at a line speed of 45 feet/minute. The UV dose was equal to, 1.6 J/cm$^2$ with a peak irradiance of 8.9 W/cm$^2$. In the UV+Thermal cure comparison the samples were given an additional heat treatment at 121° C. for 2 hours.

The CUT/LOSS ratios measured in the Schieffer test were as shown in the Table below.

| SAMPLE | NO THERMAL | WITH THERMAL |
|---|---|---|
| ELECTRON BEAM | 4.89 | — |
| UV ALONE | 6.818 | 8.555 |
| UV + THERMAL | 6.509 | 7.504 |
| CONTROL | 0.723 | 0.723 |

Cure of the control took 7 hours at about 120° C. The cures of the samples according to the invention were accomplished in minutes.

As can be seen from the above date, not only was cure obtained at a much faster rate, but the amount cut by the discs under the schieffer test was far superior to that of the control disc.

What is claimed is:

1. A paper-backed coated abrasive comprising a hydrophobic radiation-curable resin maker and/or size coat.

2. A coated abrasive according to claim 1 in which the hydrophobic resin is curable by UV radiation.

3. A coated abrasive according to claim 1 in which the resin comprises a liquid epoxyacrylate binder component.

4. A coated abrasive according to claim 3 in which the resin further comprises a siloxane with pendant acrylate functional groups.

5. A coated abrasive according to claim 1 in which the resin is curable using electron beam radiation.

6. A coated abrasive according to claim 1 in which the paper backing is a fiber reinforced paper.

7. A process for the production of a waterproof paper-backed coated abrasive said process comprising applying to a paper backing, in sequence, a maker coat, a layer of abrasive particles and a size coat, wherein at least one of the maker and size coats comprises a hydrophobic resin binder and curing the binder by radiation selected from the group consisting of electron beam radiation and UV radiation.

8. A process according to claim 7 further comprising subjecting said binder to a thermal cure treatment.

9. A process according to claim 7 in which the hydrophobic resin comprises a liquid epoxyacrylate resin.

10. A process according to claim 7 in which the resin further comprises an additive selected from the group consisting of (meth)acrylate functional silanes and siloxanes and mixtures thereof.

11. A process according to claim 7 in which said hydrophobic resin is applied for both maker and size coats.

* * * * *